US005616277A

United States Patent [19]

Raleigh et al.

[11] Patent Number: 5,616,277

[45] Date of Patent: Apr. 1, 1997

[54] INCORPORATING NONIONIC SURFACTANT INTO SILICATE FOR GRANULAR AUTOMATIC DISHWASHING DETERGENT COMPOSITION

[75] Inventors: Mary E. Raleigh, Mason; Jeffrey D. Painter, Loveland, both of Ohio

[73] Assignee: The Procter & Gamble Company, Cincinnati, Ohio

[21] Appl. No.: 668,393

[22] Filed: Jun. 25, 1996

Related U.S. Application Data

[63] Continuation of Ser. No. 52,860, Apr. 26, 1993, abandoned, which is a continuation of Ser. No. 744,610, Aug. 13, 1991, abandoned.

[51] Int. Cl.[6] ..... C11D 3/08; C11D 7/14; C11D 11/02

[52] U.S. Cl. ..... 510/220; 510/228; 510/232; 510/233

[58] Field of Search ..... 252/135, 174.21, 252/174.23

[56] References Cited

U.S. PATENT DOCUMENTS

| | | | |
|---|---|---|---|
| 2,895,916 | 7/1959 | Milenkevich et al. . | |
| 3,112,274 | 11/1959 | Morgenthaler et al. . | |
| 3,247,118 | 4/1966 | Matthaei . | |
| 3,306,858 | 2/1967 | Oberle . | |
| 3,359,207 | 12/1967 | Kaneko et al. . | |
| 3,361,675 | 1/1968 | Fuchs et al. . | |
| 3,609,088 | 9/1971 | Sumner . | |
| 3,625,902 | 12/1971 | Sumner . | |
| 3,741,904 | 6/1973 | Christensen et al. . | |
| 3,839,226 | 10/1974 | Yates | 252/454 |
| 3,888,781 | 6/1975 | Kingry et al. | 252/99 |
| 3,920,586 | 11/1975 | Bonaparte et al. | 252/531 |
| 3,933,670 | 1/1976 | Brill et al. . | |
| 3,956,467 | 5/1976 | Bertorelli . | |
| 4,011,302 | 3/1977 | Defrawi | 423/332 |
| 4,077,897 | 3/1978 | Gault . | |
| 4,169,806 | 10/1979 | Davis et al. . | |
| 4,237,024 | 12/1980 | Fedechko . | |
| 4,379,069 | 4/1983 | Rapisarda et al. . | |
| 4,379,080 | 4/1983 | Murphy . | |
| 4,411,809 | 10/1983 | Wixon . | |
| 4,414,129 | 11/1983 | Joshi . | |
| 4,427,417 | 1/1984 | Porasik . | |
| 4,588,515 | 5/1986 | Schuh et al. . | |
| 4,637,891 | 1/1987 | Delwel et al. | 252/135 |
| 4,661,281 | 4/1987 | Seiter et al. | 252/140 |
| 4,714,562 | 12/1987 | Roselle et al. . | |
| 4,726,908 | 2/1988 | Kruse et al. . | |
| 4,731,196 | 3/1988 | Staton et al. . | |
| 4,923,628 | 5/1990 | Appel et al. . | |
| 4,923,636 | 5/1990 | Blackburn et al. . | |
| 4,931,203 | 6/1990 | Ahmed et al. . | |
| 4,988,454 | 1/1991 | Eertink et al. . | |

FOREIGN PATENT DOCUMENTS

| | | | |
|---|---|---|---|
| 1141619 | 2/1983 | Canada | C11D 3/08 |
| 2006687 | 6/1990 | Canada . | |
| 0330060 | 8/1989 | European Pat. Off. . | |
| 0360330 | 3/1990 | European Pat. Off. . | |

OTHER PUBLICATIONS

Kirk–Othmer: Encyclopedia of Chemical Technology, John Wiley & Sons, Inc, 1993, vol. 7, pp. 1076–1079.

"Britesil Hydrous Polysilicates", PQ Corporation Bulletin 17–107.

*Primary Examiner*—Ponnathapura Achutamurthy

*Attorney, Agent, or Firm*—Michael D. Jones; Mary Pat McMahon; George W. Allen

[57] ABSTRACT

A process for preparing a granular automatic dishwashing detergent composition with improved solubility which comprises incorporating low foaming nonionic surfactant with a melting point between about 77° F. (25° C.) and about 140° F. (60° C.) into alkali metal silicate particles, and admixing the silicate with substantially silicate free base granules.

26 Claims, No Drawings

INCORPORATING NONIONIC SURFACTANT INTO SILICATE FOR GRANULAR AUTOMATIC DISHWASHING DETERGENT COMPOSITION

This is a continuation of application Ser. No. 08/052,860, filed on Apr. 26, 1993, which is a continuation of application Ser. No. 07/744,610, filed on Aug. 13, 1991, now abandoned.

TECHNICAL FIELD

The present invention relates to a process for making a granular automatic dishwashing detergent composition exhibiting improved solubility. More specifically, the process comprises incorporating nonionic surfactant into alkali metal silicate particles and admixing the silicate with base granules which are substantially free of silicate.

BACKGROUND OF THE INVENTION

Granular automatic dishwashing detergent compositions and their components, e.g. builders, alkaline salts, sodium silicate, low-foaming surfactants, chlorine bleach, etc., are well known in the art. A number of processes have been described for the production of such dishwashing detergent compositions.

Various processes can be used in manufacturing a granular automatic dishwashing detergent composition. For example, U.S. Pat. No. 4,379,069, Rapisarda et al., issued Apr. 5, 1983 describes a mechanical mixing process whereby a silicate free alkaline blend of detergent ingredients is prepared followed by mixing of solid alkali metal silicate. Another example involves agglomeration of detergent ingredients (see U.S. Pat. Nos. 4,427,417, Porasik, issued Jan. 24, 1984, and 3,888,781, Kingry et al., issued Jun. 10, 1975).

Any residue from automatic dishwashing detergents that remains on the dishware after washing can be a problem. This residue has been evaluated analytically and has been found to be predominantly silicate. Alkali metal silicate is known to form insoluble matter when exposed to less alkaline environments and/or other conditions which promote polymerization ($CO_2$ absorption, dehydration, etc.).

It has recently been found that a significant improvement in the solubility (i.e. decreased insoluble residue) of an agglomerated automatic dishwashing detergent composition can be achieved by using a liquid binder other than alkali metal silicate solution, such as an aqueous solution of a water-soluble polymer like sodium polyacrylate (Copending U.S. patent application Ser. No. 550,420, filed Jul. 19, 1990). It is known that during drying of the wet agglomerates, the water-soluble polymer does not form insoluble residue like alkali metal silicates do. Further, granules agglomerated with a water-soluble polymer such as polyacrylate will not develop insoluble particles during storage as do base granules which are agglomerated using an aqueous solution of silicate. The alkali metal silicate can be post-added as a dry solid to the agglomerated base product to lower the amount of insoluble residue formation.

Preferably, a relatively high level of nonionic surfactant is desired in an automatic dishwashing detergent because of its cleaning function as well as a "water sheeting" effect. The latter function is important in that it allows for water to more easily drain from tableware thus leaving the tableware with a spotless appearance. However, problems arise relating to nonionic surfactant levels when a concentrated granular automatic dishwashing detergent composition is made. In order to form a concentrated automatic dishwashing detergent composition, less filler, i.e. sulfate, is used in the agglomeration or manufacturing process, and significantly more active ingredients, including liquid ingredients, must be packed into the formula. There are fewer solids onto which these higher levels of liquid ingredients can be loaded. Because of the reduced amount of filler and the higher level of liquids, the amount of nonionic surfactant that can be added in the agglomeration or manufacturing process is reduced dramatically. It was thought that adding nonionic surfactant onto solid silicate would lower the pH in localized areas of the silicate particles, resulting in polymerization of the silicate and formation of insoluble residue (see U.S. Pat. No. 4,379,069, Rapisarda, issued Apr. 5, 1983, column 6, lines 46–52).

It has now been found that incorporating heated low foaming nonionic surfactant (which is solid at room temperature) into silicate particles, before the silicate is admixed with base granules, improves the solubility of an automatic dishwashing detergent composition. It also provides a means for incorporating a sufficient amount of nonionic surfactant into a concentrated detergent composition. Without meaning to be bound by theory, it is believed that the nonionic surfactant prevents further polymerization of the silicate thereby preventing the formation of insoluble residue.

SUMMARY OF THE INVENTION

The present invention encompasses processes for making granular automatic dishwashing detergents exhibiting improved solubility, comprising:

(a) incorporating alkali metal silicate particles with from about 5% to about 30%, by weight of the silicate, of low foaming nonionic surfactant with a melting point between about 77° F. (25° C.) and about 140° F. (60° C.), said nonionic surfactant being in a substantially liquid form;

(b) forming base granules which are substantially free of alkali metal silicate, said base granules comprising from about 5% to about 100%, by weight of the base granules, of detergency builder; and (c) admixing said silicate particles of step (a) with said base granules of step (b) in a weight ratio of between about 1:20 and about 10:1.

Those nonionic surfactants which are solid at room temperature enhance the solubility of the composition and decrease the amount of residue formed on the raw silicate particles during storage. In addition, incorporating nonionic surfactant into silicate particles provides a means for achieving high nonionic surfactant levels in a concentrated granular automatic dishwashing detergent composition.

DETAILED DESCRIPTION OF THE INVENTION

The granular detergent making process of the present invention comprises incorporating low foaming nonionic surfactant into silicate particles followed by admixing the silicate particles with base granules formed by a separate process. Bleach is preferably also admixed in the composition. The component materials are described in detail below.

SILICATE PARTICLES

The compositions of the type described herein deliver their bleach and alkalinity to the wash water very quickly. Accordingly, they can be aggressive to metals, dishware, and other materials, which can result in either discoloration by etching, chemical reaction, etc. or weight loss. The alkali metal silicates hereinafter described provide protection against corrosion of metals and against attack on dishware, including fine china and glassware.

The $SiO_2$ level should be from about 4% to about 25%, preferably from about 5% to about 20%, more preferably from about 6% to about 15%, based on the weight of the automatic dishwashing detergent composition. The ratio of $SiO_2$ to the alkali metal oxide ($M_2O$, where M=alkali metal) is typically from about 1 to about 3.2, preferably from about 1.6 to about 3, more preferably from about 2 to about 2.4. Preferably, the alkali metal silicate is hydrous, having from about 15% to about 25% water, more preferably, from about 17% to about 20%.

The highly alkaline metasilicates can be employed, although the less alkaline hydrous alkali metal silicates having a $SiO_2$:$M_2O$ ratio of from about 2.0 to about 2.4 are preferred. Anhydrous forms of the alkali metal silicates with a $SiO_2$:$M_2O$ ratio of 2.0 or more are less preferred because they tend to be significantly less soluble than the hydrous alkali metal silicates having the same ratio.

Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil H20 and Britesil H24. Most preferred is a granular hydrous sodium silicate having a $SiO_2$:$Na_2O$ ratio of 2.0.

While typical forms, i.e. powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

NONIONIC SURFACTANT

The low foaming nonionic surfactants incorporated into the silicate particles in the present invention are those which are solid at about 95° F. (35° C.), more preferably those which are solid at about 77° F. (25° C.). In addition, the nonionic surfactant must have a melting point between about 77° F. (25° C.) and about 140° F. (60° C.), preferably between about 80° F. (26.6° C.) and 110° F. (43.3° C.) in order that the surfactant can be readily used in substantially liquid form to incorporate into the silicate particles. From about 5% to about 30%, preferably from about 10% to about 20%, by weight of the silicate, of nonionic surfactant can be incorporated into the silicate particles.

Herein, by "low foaming" is meant that the nonionic surfactant is suitable for use in an automatic dishwasher.

Reduced surfactant mobility is a consideration in stability of the optional bleach component. Preferred surfactant compositions with relatively low solubility can be incorporated in compositions containing alkali metal dichlorocyanurates or other organic chlorine bleaches without an interaction that results in loss of available chlorine. The nature of this problem is disclosed in U.S. Pat. No. 4,309,299 issued Jan. 5, 1982 to Rapisarda et al and in U.S. Pat. No. 3,359,207, issued Dec. 19, 1967, to Kaneko et al, both patents being incorporated herein by reference.

In a preferred embodiment, the surfactant is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred ethoxylated nonionic surfactant is derived from a straight chain fatty alcohol containing from about 16 to about 20 carbon atoms ($C_{16-20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The ethoxylated nonionic surfactant can optionally contain propylene oxide in an amount up to about 15% by weight of the surfactant and retain the advantages hereinafter described. Preferred surfactants of the invention can be prepared by the processes described in U.S. Pat. No. 4,223,163, issued Sep. 16, 1980, Builloty, incorporated herein by reference.

The most preferred composition contains the ethoxylated monohydroxyalcohol or alkyl phenol and additionally comprises a polyoxyethylene, polyoxypropylene block polymeric compound; the ethoxylated monohydroxy alcohol or alkyl phenol nonionic surfactant comprising from about 20% to about 80%, preferably from about 30% to about 70%, of the total surfactant composition by weight.

Suitable block polyoxyethylene-polyoxypropylene polymeric compounds that meet the requirements described hereinbefore include those based on ethylene glycol, propylene glycol, glycerol, trimethylolpropane and ethylenediamine as the initiator reactive hydrogen compound. Polymeric compounds made from a sequential ethoxylation and propoxylation of initiator compounds with a single reactive hydrogen atom, such as $C_{12-18}$ aliphatic alcohols, do not provide satisfactory suds control in the detergent compositions of the invention. Certain of the block polymer surfactant compounds designated PLURONIC and TETRONIC by the BASF-Wyandotte Corp., Wyandotte, Mich., are suitable in the surfactant compositions of the invention.

A particularly preferred embodiment contains from about 40% to about 70% of a polyoxypropylene, polyoxyethylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene, initiated with tri-methylol propane, containing 99 moles of propylene oxide and 24 moles of ethylene oxide per mole of trimethylol propane.

Because of the relatively high polyoxypropylene content, e.g, up to about 90% of the block polyoxyethylene-polyoxypropylene polymeric compounds of the invention and particularly when the polyoxypropylene chains are in the terminal position, the compounds are suitable for use in the surfactant compositions of the invention and have relatively low cloud points. Cloud points of 1% solutions in water are typically below about 32° C. and preferably from about 15° C. to about 30° C. for optimum control of sudsing throughout a full range of water temperatures and water hardnesses.

DETERGENCY BUILDER

The detergency builders used to form the base granules can be any of the detergency builders known in the art, which include the various water-soluble, alkali metal, ammonium or substituted ammonium phosphates, polyphosphates, phosphonates, polyphosphonates, carbonates, borates, polyhydroxysulfonates, polyacetates, carboxylates (e.g. citrates), and polycarboxylates. Preferred are the alkali metal, especially sodium, salts of the above and mixtures thereof.

The amount of builder used to form the base granule is from about 5% to about 100%, preferably from about 20% to about 80%, by weight of the base granule. The builder is present in the automatic dishwashing detergent composition in an amount from about 5% to about 90%, most preferably from about 15% to about 75%, by weight of the automatic dishwashing detergent composition.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137, 3,400,176 and 3,400,148, incorporated herein by reference.

Examples of non-phosphorus, inorganic builders are sodium and potassium carbonate, bicarbonate, sesquicarbonate and hydroxide.

Water-soluble, non-phosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithim, ammonium and substituted ammonium salts of ethylene diamine tetraacetic acid, nitrilotriacetic acid, tartrate monosuccinic acid, tartrate disuccinic acid, oxydisuccinic acid, carboxy methyloxysuccinic acid, mellitic acid, benzene polycarboxylic acids, and citric acid.

Preferred detergency builders have the ability to remove metal ions other than alkali metal ions from washing solutions by sequestration, which as defined herein includes chelation, or by precipitation reactions. Sodium tripolyphosphate is a particularly preferred detergency builder material which is a sequestering agent. Sodium citrate is also a particularly preferred detergency builder, particularly when it is desirable to reduce the total phosphorus level of the compositions of the invention.

Particularly preferred automatic dishwashing detergent compositions of the invention contain, by weight of the automatic dishwashing detergent composition, from about 5% to about 40%, preferably from about 10% to about 30%, most preferably from about 15% to about 20%, of sodium carbonate. Particularly preferred as a replacement for the phosphate builder is sodium citrate with levels from about 5% to about 30%, preferably from about 7% to 25%, most preferably from about 8% to about 20%, by weight of the automatic dishwashing detergent composition.

OTHER SURFACTANT

The base granules herein can additionally contain a bleach-stable surfactant. The surfactant can be present in the composition in an amount from about 0.1% to about 8%, preferably from about 0.5% to about 5%, by weight of the composition.

The surfactant can be incorporated into the base granules herein by first loading the surfactant onto the builders, and other optional ingredients (i.e., sulfate), and/or by applying it onto the base detergent granule after granule formation, or spray drying it with builders and other optional ingredients.

Suitable surfactants include anionic surfactants including alkyl sulfonates containing from about 8 to about 20 carbon atoms, alkyl benzene sulfonates containing from about 6 to about 13 carbon atoms in the alkyl group, and the preferred low-sudsing mono- and/or dialkyl phenyl oxide mono- and/or di-sulfonates wherein the alkyl groups contain from about 6 to about 16 carbon atoms are also useful in the present invention. All of these anionic surfactants are used as stable salts, preferably sodium and/or potassium.

Other surfactants include the low foaming nonionic surfactants, which are discussed above, and bleach-stable surfactants including trialkyl amine oxides, betaines, etc. which are usually high sudsing. A disclosure of bleach-stable surfactants can be found in published British Patent Application No. 2,116,199A; U.S. Pat. Nos. 4,005,027, Hartman; 4,116,851, Rupe et al; and 4,116,849, Leikhim, all of which are incorporated herein by reference.

The preferred surfactants of the invention in combination with the other components of the composition provide excellent cleaning and outstanding performance from the standpoints of residual spotting and filming. In these respects, the preferred surfactants of the invention provide generally superior performance relative to ethoxylated nonionic surfactants with hydrophobic groups other than monohydroxy alcohols and alkyl-phenols, for example, polypropylene oxide or polypropylene oxide in combination with diols, triols and other polyglycols or diamines.

BLEACH INGREDIENT

The compositions of the invention optionally contain an amount of bleach sufficient to provide the composition with from 0% to about 5%, preferably from about 0.1% to about 5.0%, most preferably from about 0.5% to about 3.0%, of available chlorine or available oxygen based on the weight of the detergent composition.

An inorganic chlorine bleach ingredient such as chlorinated trisodium phosphate can be utilized, but organic chlorine bleaches such as the chlorocyanurates are preferred. Water-soluble dichlorocyanurates such as sodium or potassium dichloroisocyanurate dihydrate are particularly preferred.

Methods of determining "available chlorine" of compositions incorporating chlorine bleach materials such as hypochlorites and chlorocyanurates are well known in the art. Available chlorine is the chlorine which can be liberated by acidification of a solution of hypochlorite ions (or a material that can form hypochlorite ions in solution) and at least a molar equivalent amount of chloride ions. A conventional analytical method of determining available chlorine is addition of an excess of an iodide salt and titration of the liberated free iodine with a reducing agent.

The detergent compositions manufactured according to the present invention can contain bleach components other than the chlorine type. For example, oxygen-type bleaches described in U.S. Pat. No. 4,412,934 (Chung et al), issued Nov. 1, 1983, and peroxyacid bleaches described in European Patent Application 033,2259, Sagel et al, published Sep. 13, 1989, both incorporated herein by reference, can be used as a partial or complete replacement of the chlorine bleach ingredient described hereinbefore. These oxygen bleaches are particularly preferred when it is desirable to reduce the total chlorine content or use enzyme in the compositions of the invention.

LIQUID BINDER

When the base granules are formed by an agglomeration process, a liquid binder is necessary. The liquid binder, which is substantially free of silicate, can be employed in forming the base granules in an amount from about 3% to about 45%, preferably from about 4% to about 25%, most preferably from about 5% to about 20%, by weight of the base granules. The liquid binder can be water, aqueous solutions of alkali metal salts of a polycarboxylic acid, and/or nonionic surfactant.

The liquid binder can be an aqueous solution of a water-soluble polymer. This solution can comprise from about 10% to about 70%, preferably from about 20% to about 60%, and most preferably from about 30% to about 50%, by weight of the water-soluble polymer.

Solutions of the film-forming polymers described in U.S. Pat. No. 4,379,080 (Murphy), issued Apr. 5, 1983, incorporated herein by reference, can be used as the liquid binder.

Suitable polymers for use in the aqueous solutions are at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 2000 to about 250,000, and most preferably is from about 3000 to about 100,000.

Other suitable polymers include those disclosed in U.S. Pat. No. 3,308,067 issued Mar. 7, 1967, to Diehl, incorporated herein by reference. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as vinylmethyl ether, styrene, ethylene, etc. is suitable provided that such segments do not constitute more than about 40% by weight of the polymer.

Other suitable polymers for use herein are copolymers of acrylamide and acrylate having a molecular weight of from about 3,000 to about 100,000, preferably from about 4,000 to about 20,000, and an acrylamide content of less than about 50%, preferably less than about 20%, by weight of the polymer. Most preferably, the polymer has a molecular weight of from about 4,000 to about 20,000 and an acrylamide content of from about 0% to about 15%, by weight of the polymer.

Particularly preferred liquid binders are aqueous solutions of polyacrylates with an average molecular weight in acid form of from about 1,000 to about 10,000, and acrylate/maleate or acrylate/fumarate copolymers with an average molecular weight in acid form of from about 2,000 to about 80,000 and a ratio of acrylate of maleate or fumarate segments of from about 30:1 to about 2:1. This and other suitable copolymers based on a mixture of unsaturated mono- and dicarboxylate monomers are disclosed in European Patent Application No. 66,915, published Dec. 15, 1982, incorporated herein by reference.

Other polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol.

The polyethylene, polypropylene and mixed glycols are conveniently referred to by means of the structural formula $$HO-(CH_2-CH_2O)_m-(CH_2-\overset{\overset{CH_3}{|}}{C}HO)_n-(\overset{\overset{CH_3}{|}}{C}H-CH_2O)_o-H$$

wherein m, n, and o are integers satisfying the molecular weight and temperature requirements given above.

Other polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; and the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred polymers of the above group are the carboxymethyl celluloses.

Low-foaming nonionic surfactants described above can be used as the liquid binder, provided they are in the liquid form or are premixed with another liquid binder. These surfactants are particularly preferred when used in conjunction with the polymers described hereinbefore.

In general, the liquid binder can comprise any one or a mixture of the binders described above.

OPTIONAL INGREDIENTS

The automatic dishwashing compositions of the invention can optionally contain up to about 50%, preferably from about 2% to about 20%, most preferably less than about 4%, based on the weight of the low-foaming surfactant, of an alkyl phosphate ester suds suppressor.

Suitable alkyl phosphate esters are disclosed in U.S. Pat. No. 3,314,891, issued Apr. 18, 1967, to Schmolka et al, incorporated herein by reference.

The preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

The alkyl phosphate esters have been used to reduce the sudsing of detergent compositions suitable for use in automatic dishwashing machines. The esters are particularly effective for reducing the sudsing of compositions comprising nonionic surfactants which are block polymers of ethylene oxide and propylene oxide.

Filler materials can also be present including sucrose, sucrose esters, sodium chloride, sodium sulfate, potassium chloride, potassium sulfate, etc., in amounts up to about 70%, preferably from 0% to about 40%.

Hydrotrope materials such as sodium benzene sulfonate, sodium toluene sulfonate, sodium cumene sulfonate, etc., can be present in minor amounts.

Bleach-stable perfumes (stable as to odor); bleach-stable dyes (such as those disclosed in U.S. Pat. No. 4,714,562, Roselle et al, issued Dec. 22, 1987); and bleach-stable enzymes and crystal modifiers and the like can also be added to the present compositions in appropriate amounts. Other commonly used detergent ingredients can also be included.

THE PROCESS

In step (a), nonionic surfactant having a melting point between about 77° F. (25° C.) and about 140° F. (60° C.), preferably heated to between about 80° F. (26.6° C.) and about 220° F. (104.4° C.), preferably between about 140° F. (60° C.) and 200° F. (93.3° C.), is added to alkali metal silicate particles. The nonionic surfactant is in substantially liquid form to facilitate incorporation into the silicate particles. Conventional methods are used which provide sufficient liquid-to-solid particle contact to incorporate the nonionic surfactant into the silicate. Such methods include vertical agglomerators/mixers (preferably a continuous Schugi Flexomix or Bepex Turboflex), other agglomerators (e.g. Zig-Zag agglomerator, pan agglomerators, twin cone agglomerators, etc.), rotating drums and any other device with suitable means of agitation and liquid spray-on. The apparatus may be designed or adapted for either continuous or batch operation as long as the essential process steps can be achieved. The nonionic surfactant of step (a) is preferably heated to between about 77° F. (25° C.) and about 220° F. (104.4° C.), more preferably between about 140° F. (60° C.) and 200° F. (93.3° C.). Once the silicate particles have been incorporated with heated, liquified nonionic surfactant, the particles preferably are subsequently cooled.

A preferred method is to melt and heat the nonionic surfactant to between about 170° F. (70.6° C.) and about 190° F. (87.8° C.), preferably about 180° F. (82.2° C.), followed by applying the liquified surfactant onto the silicate particles via a Schugi mixer. This mixture then falls by gravity into a continuous plough-type mixer which is kept well above the melting point of the surfactant by circulating warm air through the mixer.

The warm silicate intermediate particles exit the first plough mixer and fall by gravity into a second plough mixer which is provided with cool dry air which sufficiently cools the particles to about 75° F. (23.9° C.). The resulting particles are crisp and free flowing. Upon exiting the second plough mixer, oversized particles are scalped, ground and returned to the first plough mixer. Particles of acceptable size can then be admixed as described hereinafter.

The formation of the base granules, which are substantially free of silicate, can be carried out in any conventional mixing process. Agglomeration is a preferred method and any agglomeration equipment which facilitates mixing and intimate contacting of the liquid binder with dry detergent ingredients such that it results in agglomerated granules comprising a detergency builder and the liquid binder can be used. Suitable mixing devices include vertical agglomerators (e.g. Schugi Flexomix or Bepex Turboflex agglomerators), rotating drums, inclined pan agglomerators, O'Brien mixers, and any other device with suitable means of agitation and liquid spray-on. Methods of agitating, mixing, and agglomerating particulate components are well-known to those skilled in the art. The apparatus may be designed or adapted for either continuous or batch operation as long as the essential process steps can be achieved.

Once agglomerated, the base granule preferably goes through a conditioning step before admixing the nonionic surfactant incorporated silicate and optional bleaching agent. Conditioning is defined herein as that processing necessary to allow the base granule to come to equilibrium with respect to temperature and moisture content. This could involve drying off excess water introduced with the liquid binder via suitable drying equipment including fluidized beds, rotary drums, etc. The free moisture content of the base granule should be less than about 6%, preferably less than about 3%. As used herein, free-moisture content is determined by placing 5 grams of a sample of base detergent granules in a petri dish, placing the sample in a convection oven at 50° C. (122° F.) for 2 hours, followed by measurement of the weight loss due to water evaporation. If the liquid binder does not introduce an excess of water, conditioning may involve merely allowing time to reach equilibrium before admixing the silicate.

In cases where the compositions contain hydratable salts, it is preferable to hydrate them prior to the agglomeration step using the hydration process described in, e.g. U.S. Pat. No. 4,427,417 issued Jan. 24, 1984 to Porasik, incorporated herein by reference.

The final step is to admix the nonionic surfactant incorporated silicate, base granules, optional sodium citrate, and optional bleaching agent using any suitable batch or continuous mixing process, so long as a homogeneous mixture results therefrom. A preferred embodiment is an admixture containing a nonionic surfactant incorporated silicate:base granule weight ratio of between about 1:20 and about 10:1, respectively, more preferably between about 1:12 and about 5:1, most preferably between about 1:3 and about 2:1.

Optional process steps include screening and/or premixing of dry detergent ingredients before agglomeration, pre-hydration of hydratable salts, and screening and/or grinding of the base granule or final product to any desired particle size.

Concentrated automatic dishwashing detergent compositions are preferred herein. Compositions containing greater than about 60% active ingredients, preferably between about 70% and about 95% active ingredients are preferred. Preferably, from about 5% to about 98%, most preferably from about 15% to about 70%, of the automatic dishwashing detergent composition is base granule, and from about 2% to about 80%, preferably from about 20% to about 40%, is incorporated silicate.

As used herein, all percentages, parts, and ratios are by weight unless otherwise stated.

The following nonlimiting Examples illustrate the process of the invention and facilitate its understanding.

EXAMPLE I

The low-foaming nonionic surfactant and silicate particles used to form the incorporated nonionic surfactant silicate are set forth in Table 1. The nonionic surfactant is incorporated by heating the surfactant to 140° F. (60° C.) and slowly adding it to the silicate particles while mixing in a Hobart mixer. After addition of the liquid nonionic surfactant is completed, mixing is continued for 1 minute more.

TABLE 1

| | Wt. % of Silicate Particle | |
|---|---|---|
| | A | B |
| Hydrous sodium silicate (1) | 100% | 83.4 |
| Nonionic surfactant (2) | | 16.6 |

(1) 2.0 ratio $SiO_2$:$Na_2O$, Britesil H2O.
(2) Blend, by weight of total surfactant, of 38.7% monohydroxy ($C_{18}$) alcohol which has been ethoxylated with 8 moles of ethylene oxide per mole of alcohol, 58.1% of polyoxypropylene/polyoxethylene reverse block polymer and 3.2% monostearylacid phosphate.

The silicate particles prepared according to Methods A and B are evaluated for solubility using a standard $CO_2$ chamber aging procedure which evaluates the relative resistance of products to insoluble formation during storage. The results obtained from this method correlate well with actual aged solubility results obtained from storage testing.

Multiple ten gram samples of both products are placed in Petri dishes in a $CO_2$ chamber with a $CO_2$ level of 15%. Duplicate samples of each product are removed after 2 and 4 hours in the $CO_2$ chamber. The solubility of the samples is evaluated using the Jumbo Black Fabric Deposition Test (JBFDT), which is used to evaluate the solubility of detergent products. The grading scale for the JBFDT is a visual scale with 10 being completely soluble (no deposition) and 3 being completely insoluble.

Results for the samples prepared are shown in Table 2.

TABLE 2

| | Solubility Grade | |
|---|---|---|
| | A | B |
| Initial Sample (t = 0) | — | 9.5 |
| 2 hours in $CO_2$ chamber | 4.0 | 8.5 |
| 4 hours in $CO_2$ chamber | 3.0 | 7.5 |

The silicate sample which is incorporated with low foaming nonionic surfactant (Method B) demonstrates significantly improved solubility over the silicate alone.

The silicate particles prepared according to Methods A and B are evaluated for crusting using a room which is controlled at 80° F. (26.6° C.) and 80% relative humidity. Samples are placed in a lidded carton with the lid left open and then left in the controlled room. Samples are then removed from the room for evaluation. The sample in which no nonionic surfactant is incorporated (Method A) develops a very hard crusty layer and is virtually unscoopable. The sample incorporated with nonionic surfactant (Method B) is easily scoopable having formed only a very thin crust.

EXAMPLE II

Low foaming nonionic surfactant is incorporated into silicate particles by heating the nonionic surfactant to 180° F. (82.2° C.), and spraying the liquid surfactant through nozzles onto the silicate in a Schugi Flexomix 160 vertical agglomerator, followed by mixing in a continuous plough mixer for a residence time of about 5 minutes.

TABLE 3

| | Wt. % of Silicate Particle | |
|---|---|---|
| | A | B |
| Hydrous sodium silicate (1) | 100% | 83.4 |
| Nonionic surfactant (2) | | 16.6 |

(1) 2.0 ratio $SiO_2$:$Na_2O$ Britesil H2O.
(2) Blend, by weight of total surfactant, of 38.7% monohydroxy ($C_{18}$) alcohol which has been ethoxylated with 8 moles of ethylene oxide per mole of alcohol, 58.1% of polyoxypropylene/polyoxethylene reverse block polymer and 3.2% monostearylacid phosphate.

The two silicate samples are evaluated for solubility using the rapid aging method described in Example I.

Results for the compositions are shown in Table 4.

TABLE 4

| | Solubility Grade | |
|---|---|---|
| | A | B |
| Initial sample (t = 0) | — | 9.5 |
| 2 hours in $CO_2$ chamber | 4.0 | 8.5 |
| 4 hours in $CO_2$ chamber | 3.0 | 7.5 |

Incorporating the nonionic surfactant into the silicate again significantly improves solubility.

The two silicate samples are evaluated for crusting using the controlled room method described in Example I. The sample in which no nonionic surfactant is incorporated (Method A) develops a hard crusty layer and is virtually unscoopable. The sample incorporated with nonionic surfactant (Method B) is easily scoopable and has formed only a thin crust.

EXAMPLE III

The liquid binder, detergency builder, and other ingredients of the base granules are set forth in Table 5.

TABLE 5

| | Wt. % of Detergent Composition | |
|---|---|---|
| | A | B |
| Sodium sulfate | 33.86 | 33.86 |
| Sodium carbonate | 16.70 | 16.70 |
| Sodium polyacrylate | 3.97 | 3.97 |
| Free water | 0.34 | 0.34 |
| Sodium citrate dihydrate | 15.49 | 15.49 |
| Sodium dichloroisocyanurate dihydrate | 3.64 | 3.64 |
| Nonionic surfactant (1) | 3.95 | |
| Hydrous sodium silicate (2) | 22.05 | |
| Nonionic surfactant/hydrous sodium silicate (3) | | 26.00 |

(1) Blend, by weight of total surfactant, of 38.7% monohydroxy ($C_{18}$) alcohol which has been ethoxylated with 8 moles of ethylene oxide per mole of alcohol, 58.1% of polyoxypropylene/polyoxethylene reverse block polymer and 3.2% monostearylacid phosphate.
(2) 2.0 ratio $SiO_2$:$Na_2O$ Britesil H2O.
(3) 16.6%, by weight of silicate particles, of nonionic surfactant blend described in (1) and 83.4% of sodium silicate, 2.0 ratio $SiO_2$:$Na_2O$ (Britesil H2O).

Agglomerated base granules are prepared by using an aqueous solution containing 45% sodium polyacrylate as the liquid binder. The dry components, sodium carbonate and sodium sulfate are agglomerated with the aqueous sodium polyacrylate using a Schugi mixer to form base granules which are then dried in a fluidized bed to a moisture content of 0.6% of the dry base granule.

In Method A the low foaming nonionic surfactant is sprayed onto the agglomerate using conventional methods. In Method B the low foaming nonionic surfactant is incorporated into the silicate.

The granular automatic dishwashing detergent compositions are made by admixing the base granules with the corresponding silicate, sodium citrate and sodium dichloroisocyanurate dihydrate.

The two compositions are evaluated for solubility using the rapid aging method described in Example I. For this experiment two graders performed multiple, blind testings.

Results for the samples prepared are shown in Table 6.

TABLE 6

| | Solubility Grade | |
|---|---|---|
| | A | B |
| Initial Sample (t = 0) | 8.2 | 9.2 |
| 2 hours in $CO_2$ chamber | 7.4 | 8.7 |
| 4 hours in $CO_2$ chamber | 7.7 | 8.2 |

The sample composition admixed with the nonionic surfactant incorporated silicate (Method B) shows a solubility advantage as compared to the sample composition in which the nonionic surfactant is incorporated into the base granule and admixed with silicate alone.

At each sampling time, the sample composition containing nonionic surfactant incorporated silicate shows less residue than the sample composition in which the nonionic surfactant is incorporated into the base granule and admixed with silicate alone. This is true for all sampling times, including the initial sample.

EXAMPLE IV

The automatic dishwashing detergent compositions set forth in Table 7 are prepared by incorporating the nonionic surfactant into different ingredients of the automatic dishwashing detergent composition.

TABLE 7

| | Wt % of Automatic Dishwashing Detergent Composition | | |
|---|---|---|---|
| | A | B | C |
| Sodium carbonate | 17.72 | 17.72 | 17.72 |
| Sodium sulfate | 35.26 | 35.26 | 35.26 |
| Sodium citrate dihydrate | 16.14 | 16.14 | 16.14 |
| Nonionic surfactant (1) | 4.11 | 4.11 | |
| Hydrous sodium silicate (2) | 22.96 | 22.96 | |
| Nonionic surfactant/hydrous sodium silicate (3) | | | 27.08 |
| Sodium dichloroisocyanurate dihydrate | 3.80 | 3.80 | 3.80 |

(1) 2.0 ratio $SiO_2$:$Na_2O$ Britesil H2O.
(2) Blend, by weight of total surfactant, of 38.7% monohydroxy ($C_{18}$) alcohol which has been ethoxylated with 8 moles of ethylene oxide per mole of alcohol, 58.1% of polyoxypropylene/polyoxethylene reverse block polymer and 3.2% monostearylacid phosphate.
(3) 16.6%, by weight of silicate particle, of nonionic surfactant blend described in (2) and 83.4% of sodium silicate, 2.0 ratio $SiO_2$:$Na_2O$ (Britesil H2O).

Method A: Sodium carbonate, sodium sulfate and sodium citrate dihydrate are mixed together, followed by slowly applying the nonionic surfactant which has been heated to 140° F. (60° C.). This product is then admixed with the sodium dichloroioscyanurate dihydrate and silicate particles.

Method B: Sodium carbonate and sodium sulfate are mixed together, followed by slowly applying the heated (140° F./60° C.) nonionic surfactant. This product is then admixed with sodium citrate, sodium dichloroisocyanurate dihydrate and silicate particles.

Method C: The nonionic surfactant incorporated silicate of Method C is made according to the method described in Example II. All the components of the detergent composition are mixed together.

The three compositions are evaluated for solubility using the rapid aging method described in Example I.

TABLE 8

| | Solubility Grade | | |
|---|---|---|---|
| | A | B | C |
| Initial sample (t = 0) | 8.5 | 8.5 | 8.7 |
| 2 hours in $CO_2$ chamber | 8.8 | 8.0 | 8.8 |
| 4 hours in $CO_2$ chamber | 7.8 | 7.8 | 8.4 |

The finished product with the nonionic surfactant incorporated into the silicate (Method C) shows a definite solubility advantage over those finished products (Methods A and B) where the nonionic surfactant is incorporated into different base granules.

EXAMPLE V

The automatic dishwashing detergent compositions set forth in Table 9 are prepared by incorporating the nonionic surfactant into different ingredients of the automatic dishwashing detergent composition.

TABLE 9

| | Wt % of Automatic Dishwashing Detergent Composition | | |
|---|---|---|---|
| | A | B | C |
| Sodium carbonate | 17.72 | 17.72 | 17.72 |
| Sodium sulfate | 35.26 | 35.26 | 35.26 |
| Sodium citrate dihydrate | 16.14 | 16.14 | 16.14 |
| Nonionic surfactant (1) | 4.11 | 4.11 | |
| Hydrous sodium silicate (2) | 22.96 | 22.96 | |
| Nonionic surfactant/hydrous sodium silicate (3) | | | 27.08 |
| Sodium dichloroisocyanurate dihydrate | 3.80 | 3.80 | 3.80 |

(1) Blend, by weight of total surfactant, of 38.7% monohydroxy ($C_{18}$) alcohol which has been ethoxylated with 8 moles of ethylene oxide per mole of alcohol, 58.1% of polyoxypropylene/polyoxethylene reverse block polymer and 3.2% monostearylacid phosphate.
(2) 2.4 ratio $SiO_{2:Na2}O$ Britesil H24.
(3) 16.6%, by weight of silicate particle, of nonionic surfactant blend as described in (1) and 83.4% of sodium silicate, 2.4 ratio $SiO_2$:$Na_2O$ (Britesil H24).

The only difference between this Example and Example IV is the hydrous silicate used. In this Example 2.4 ratio $SiO_2$:$Na_2O$ sodium silicate is used rather than 2.0 ratio $SiO_2$:$Na_2O$.

Method A: Sodium carbonate, sodium sulfate and sodium citrate dihydrate are mixed together, followed by slowly applying the nonionic surfactant which has been heated to 140° F. This product is then admixed with the sodium dichloroioscyanurate dihydrate and silicate particles.

Method B: Sodium carbonate and sodium sulfate are mixed together, followed by slowly applying the heated (140° F./60° C.) nonionic surfactant. This product is then admixed with sodium citrate, sodium dichloroisocyanurate dihydrate and silicate particles.

Method C: All the components of the detergent composition are mixed together. The nonionic surfactant incorporated silicate of Method C is made according to the method described in Example II.

The three compositions are evaluated for solubility using the rapid aging method described in Examples I and IV.

TABLE 10

| | Solubility Grade | | |
|---|---|---|---|
| | A | B | C |
| Initial sample (t = 0) | 7.9 | 8.4 | 8.3 |
| 2 hours in $CO_2$ chamber | 6.3 | 6.8 | 7.4 |
| 4 hours in $CO_2$ chamber | 6.2 | 6.0 | 6.9 |

The finished product with the nonionic surfactant incorporated into the silicate (Method C) shows a definite solubility advantage over those finished products (Methods A and B) where the nonionic surfactant is incorporated with different base granules.

The invention may be embodied in other specified forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range or equivalency of the claims are therefore intended to be embraced therein.

What is claimed is:

1. A process for making a granular automatic dishwashing detergent composition, comprising:

(a) incorporating by spraying or contact mixing powder or granular alkali metal silicate particles with from about 5% to about 30%, by weight of the silicate, of low foaming nonionic surfactant with a melting point between about 77° F. (25° C.) and about 140° F. (60° C.), said nonionic surfactant being in a substantially liquid form;

(b) forming base granules which are substantially free of alkali metal silicate, wherein said base granules are formed by agglomerating, said base granules comprising from about 20% to about 80%, by weight of the base granules, of detergency builder, and from about 10% to about 70%, by weight of the base granules, of a water-soluble polymer liquid binder; and (c) admixing said silicate particles of step (a) with said base granules of step (b) in a weight ratio of between about 1:20 and about 10:1.

2. The process of claim 1 wherein the low foaming nonionic surfactant of step (a) comprises a $C_{16-20}$ straight chain alcohol condensed with an average of from about 6 to about 15 moles of ethylene oxide per mole of alcohol.

3. The process of claim 2 wherein the silicate particles of step (a) are hydrous silicate.

4. The process of claim 3 wherein the nonionic surfactant of step (a) is heated to between about 77° F. (25° C.) and about 220° F. (104.4° C.).

5. The process of claim 4 wherein from about 15% to about 25%, by weight of the silicate, of nonionic surfactant is incorporated onto the silicate particles of step (a).

6. The process of claim 5 wherein the hydrous silicate is from about 15% to about 25% water.

7. The process of claim 2 wherein the detergency builder is selected from the group consisting of water-soluble, alkali metal, ammonium or substituted ammonium phosphates, polyphosphates, phosphonates, polyphosphonates, carbonates, borates, polyhydroxysulfonates, polyacetates, carboxylates, and polycarboxylates.

8. The process of claim 7 wherein the silicate particle:base granule ratio of step (c) is between about 1:12 and 5:1.

9. The process of claim 8 further comprising admixing in step (c) an amount of bleach sufficient to provide the composition with about 0.1% to about 5% of available chlorine or available oxygen based on the weight of the detergent composition.

10. The process of claim 9 wherein the alkali metal silicate particles of step (a) have a ratio of $SiO_2$:$M_2O$ of from about 1.6 to about 3.0:1, wherein M is $K^+$ or $Na^+$ or mixtures thereof.

11. The process of claim 10 wherein the low foaming nonionic surfactant of step (a) further comprises a polyoxypropylene, polyoxyethylene block polymeric compound.

12. The process of claim 7 wherein the liquid binder is selected from the group consisting of aqueous solutions of alkali metal salts of polyacrylates with an average molecular weight in acid form of from about 1,000 to about 10,000, and acrylate/maleate or acrylate/fumarate copolymers with an average molecular weight in acid form of from about 2,000 to about 80,000 and a ratio of acrylate to maleate or fumarate segments of from about 30:1 to about 2:1, and mixtures thereof.

13. The process of claim 12 wherein the alkali metal silicate particles of step (a) have a ratio of $SiO_2$:$M_2O$ of from about 2.0:1 to about 2.4:1, wherein M is $K^+$ or $Na^+$ or mixtures thereof.

14. The process of claim 12 wherein the low foaming nonionic surfactant of step (a) comprises a $C_{18}$ alcohol condensed with an average of from about 7 to about 9 moles of ethylene oxide per mole of alcohol.

15. The process of claim 12 wherein the low foaming nonionic surfactant of step (a) further comprises from about 2% to about 20% of an alkyl phosphate ester suds suppressor.

16. The process of claim 14 further comprising less than about 4% of a monooleyl or monostearyl acid phosphate, or salts thereof.

17. The process of claim 16 wherein the nonionic surfactant of step (a) is heated to between about 140° F. (60° C.) and 200° F. (93.3° C.).

18. The process of claim 17 wherein the liquified nonionic surfactant is sprayed onto the silicate particles of step (a).

19. The process of claim 13 wherein the bleach ingredient comprises chlorocyanurate.

20. The process of claim 18 wherein the detergency builders are, by weight of the composition, from about 15% to about 20% sodium carbonate and from about 8% to about 20% sodium citrate.

21. The process of claim 20 wherein the silicate particles are mixed during spray on of the liquified nonionic surfactant, and are subsequently cooled before admixing.

22. The process of claim 12 further comprising drying the base granules of step (b) to a free-moisture content less than about 6% before admixing the silicate of step (a).

23. The process of claim 20 further comprising adding anionic surfactants selected from the group consisting of alkyl sulfonates containing from about 8 to about 20 carbon atoms, alkyl benzene sulfonates containing from about 6 to about 13 carbon atoms in the carbon atoms in the alkyl group and the mono- and/or dialkyl phenyl oxide, mono and/or di-sulfonates wherein the alkyl groups contain from about 6 to about 16 carbon atoms, and mixtures thereof.

24. The process of claim 11 wherein from about 40% to about 70% of the polyoxypropylene, polyoxyethylene block polymeric compound is about 75%, by weight of the compound, of a reverse block co-polymer of polyoxyethylene and polyoxypropylene containing 17 moles of ethylene oxide and 44 moles of propylene oxide; and about 25%, by weight of the compound, of a block co-polymer of polyoxyethylene and polyoxypropylene, initiated with trimethyl propane, containing 99 moles of propylene oxide and 24 moles of ethylene oxide per mole of trimethylol propane.

25. The process of claim 24 wherein the heated nonionic surfactant is applied onto the silicate particles via a mixer, and the resulting particles are cooled to about 75° F. (23.9° C.).

26. The process of claim 12 wherein the composition comprises from about 15% to about 70% base granules and from about 20% to about 40% incorporated silicate.

* * * * *